US010017998B2

(12) United States Patent
Bilen et al.

(10) Patent No.: US 10,017,998 B2
(45) Date of Patent: Jul. 10, 2018

(54) DRILL BITS AND EARTH-BORING TOOLS INCLUDING SHAPED CUTTING ELEMENTS AND ASSOCIATED METHODS

(71) Applicant: Baker Hughes Incorporated, Houston, TX (US)

(72) Inventors: Juan Miguel Bilen, The Woodlands, TX (US); Danny E. Scott, Montgomery, TX (US); Suresh G. Patel, The Woodlands, TX (US); Oliver Matthews, Spring, TX (US); Derek L. Nelms, Midland, TX (US); Nicholas J. Lyons, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 115 days.

(21) Appl. No.: 15/099,877

(22) Filed: Apr. 15, 2016

(65) Prior Publication Data

US 2016/0230472 A1 Aug. 11, 2016

Related U.S. Application Data

(63) Continuation of application No. 13/762,664, filed on Feb. 8, 2013, now Pat. No. 9,316,058.
(Continued)

(51) Int. Cl.
*E21B 10/56* (2006.01)
*E21B 10/55* (2006.01)
(Continued)

(52) U.S. Cl.
CPC ..... *E21B 10/5673* (2013.01); *E21B 10/42* (2013.01); *E21B 10/43* (2013.01);
(Continued)

(58) Field of Classification Search
CPC .... E21B 10/58; E21B 10/5673; E21B 10/562; E21B 10/55; E21B 10/42
See application file for complete search history.

(56) References Cited

U.S. PATENT DOCUMENTS 3,459,073 A 8/1969 Conover
4,373,593 A 2/1983 Phaal et al.
(Continued)

FOREIGN PATENT DOCUMENTS

CA 2598057 A1 3/2008
CN 2743526 Y 11/2005
(Continued)

OTHER PUBLICATIONS

International Search Report for International Application No. PCT/US2013/025318 dated Jun. 2, 2013, 4 pages.
(Continued)

*Primary Examiner* — Jennifer H Gay
(74) *Attorney, Agent, or Firm* — TraskBritt

(57) ABSTRACT

Cutting elements for an earth-boring tool include a substrate base and a cutting tip. The cutting tip may include a first generally conical surface, a second, opposite generally conical surface, a first flank surface extending between the first and second generally conical surfaces, and a second, opposite flank surface. The cutting tip may include a central axis that is not co-linear with a longitudinal axis of the substrate base. The cutting tip may include a surface defining a longitudinal end thereof that is relatively more narrow in a central region thereof than in a radially outer region thereof. Earth-boring tools include a body and a plurality of such cutting elements attached thereto, at least one cutting element oriented to initially engage a formation with the first or
(Continued)

second generally conical surface thereof. Methods of drilling a formation use such cutting elements and earth-boring tools.

19 Claims, 6 Drawing Sheets

Related U.S. Application Data

(60) Provisional application No. 61/596,433, filed on Feb. 8, 2012.

(51) Int. Cl.

| | |
|---|---|
| ***E21B 10/42*** | (2006.01) |
| ***E21B 10/58*** | (2006.01) |
| ***E21B 10/43*** | (2006.01) |
| ***E21B 10/54*** | (2006.01) |
| ***E21B 10/46*** | (2006.01) |
| ***E21B 10/08*** | (2006.01) |
| ***E21B 10/567*** | (2006.01) |
| *E21B 10/00* | (2006.01) |

(52) U.S. Cl.

CPC ..... *E21B 10/54* (2013.01); *E21B 10/55* (2013.01); *E21B 10/58* (2013.01); *E21B 10/00* (2013.01); *E21B 10/08* (2013.01); *E21B 10/46* (2013.01); *E21B 2010/562* (2013.01)

(56) References Cited

U.S. PATENT DOCUMENTS 4,440,247 A 4/1984 Sartor
4,471,845 A 9/1984 Jurgens
4,499,958 A 2/1985 Radtke et al.
4,602,691 A 7/1986 Weaver
4,705,124 A 11/1987 Abrahamson et al.
4,718,505 A 1/1988 Fuller
4,722,405 A 2/1988 Langford
4,823,892 A 4/1989 Fuller
4,832,139 A 5/1989 Minikus et al.
4,854,405 A 8/1989 Stroud
4,869,330 A 9/1989 Tibbitts
4,889,017 A 12/1989 Fuller et al.
4,942,933 A 7/1990 Barr et al.
4,981,184 A 1/1991 Knowlton et al.
RE33,757 E 12/1991 Weaver
5,135,061 A 8/1992 Newton, Jr.
5,172,777 A 12/1992 Siracki
5,172,779 A 12/1992 Siracki et al.
5,186,268 A 2/1993 Clegg
5,244,039 A 9/1993 Newton
5,303,785 A 4/1994 Duke
5,322,138 A 6/1994 Siracki et al.
5,379,853 A 1/1995 Lockwood et al.
5,415,244 A 5/1995 Portwood
5,421,423 A 6/1995 Huffstutler
5,487,436 A 1/1996 Griffin
5,505,273 A 4/1996 Azar
5,531,281 A 7/1996 Murdock
5,542,485 A 8/1996 Pessier et al.
5,549,171 A 8/1996 Mensa et al.
5,558,170 A 9/1996 Thigpen et al.
5,592,995 A 1/1997 Scott et al.
5,595,252 A 1/1997 O'Hanlon
5,607,024 A 3/1997 Keith
5,649,604 A 7/1997 Fuller
5,697,462 A 12/1997 Grimes et al.
5,706,906 A 1/1998 Jurewicz et al.
5,720,357 A 2/1998 Fuller et al.
5,813,485 A 9/1998 Portwood
5,816,346 A 10/1998 Beaton
5,871,060 A 2/1999 Jensen et al.
5,881,828 A 3/1999 Fischer et al.
5,890,552 A 4/1999 Scott et al.
5,904,213 A 5/1999 Caraway et al.
5,957,227 A 9/1999 Besson et al.
5,967,246 A 10/1999 Caraway et al.
5,992,547 A 11/1999 Caraway et al.
6,000,483 A 12/1999 Jurewicz et al.
6,003,623 A * 12/1999 Miess ..... E21B 10/55 175/426
6,053,263 A 4/2000 Meiners et al.
6,059,054 A 5/2000 Portwood et al.
6,089,336 A 7/2000 Nexton et al.
6,092,613 A 7/2000 Caraway et al.
6,098,730 A 8/2000 Scott et al.
6,105,694 A 8/2000 Scott
6,129,161 A 10/2000 Roberts et al.
6,142,250 A 11/2000 Griffin et al.
6,176,333 B1 1/2001 Doster
6,202,770 B1 3/2001 Jurewicz et al.
6,209,420 B1 4/2001 Butcher et al.
6,227,318 B1 5/2001 Siracki
6,241,035 B1 6/2001 Portwood
6,290,008 B1 9/2001 Portwood et al.
6,302,224 B1 10/2001 Sherwood, Jr.
6,328,117 B1 12/2001 Berzas et al.
6,332,503 B1 12/2001 Pessier et al.
6,401,844 B1 6/2002 Doster
6,408,958 B1 6/2002 Isbell et al.
6,425,922 B1 7/2002 Pope et al.
6,571,891 B1 6/2003 Smith et al.
6,601,662 B2 8/2003 Matthias et al.
6,612,383 B2 9/2003 Desai et al.
6,615,934 B2 9/2003 Mensa-Wilmot
6,739,417 B2 5/2004 Smith et al.
6,997,273 B2 2/2006 Singh
7,011,169 B2 3/2006 Eason
7,025,156 B1 4/2006 Caraway
7,152,703 B2 12/2006 Meiners et al.
7,216,565 B2 5/2007 Sherwood, Jr. et al.
7,546,888 B2 6/2009 Cruz
7,588,102 B2 9/2009 Hall et al.
7,594,554 B2 9/2009 Schwefe et al.
7,628,233 B1 12/2009 Hall et al.
7,641,002 B2 1/2010 Hall et al.
7,690,442 B2 4/2010 Portwood et al.
7,798,257 B2 9/2010 Shen et al.
7,836,978 B2 11/2010 Scott
8,016,059 B2 9/2011 Gatell
8,028,774 B2 10/2011 Hall et al.
8,061,457 B2 11/2011 Hall et al.
8,205,692 B2 6/2012 McDonough et al.
8,215,420 B2 7/2012 Hall et al.
8,365,845 B2 2/2013 Hall et al.
8,505,634 B2 8/2013 Lyons et al.
8,534,767 B2 9/2013 Hall et al.
8,567,532 B2 10/2013 Hall et al.
8,616,305 B2 12/2013 Hall et al.
8,678,111 B2 3/2014 Zahradnik et al.
8,714,285 B2 5/2014 Hall et al.
8,851,207 B2 10/2014 Gavia et al.
8,960,337 B2 2/2015 Hall et al.
9,074,435 B2 * 7/2015 Scott ..... E21B 10/42
9,316,058 B2 * 4/2016 Bilen ..... E21B 10/55
2003/0034180 A1 2/2003 Mensa-Wilmot
2004/0094334 A1 5/2004 Singh
2004/0149493 A1 8/2004 McDonough
2004/0184944 A1 9/2004 Geving et al.
2004/0231894 A1 11/2004 Dvorachek
2005/0023043 A1 2/2005 Tufts
2005/0183892 A1 * 8/2005 Oldham ..... E21B 7/20 175/402
2005/0263327 A1 12/2005 Meiners et al.
2006/0131075 A1 6/2006 Cruz
2006/0249309 A1 11/2006 Cruz
2007/0039761 A1 2/2007 Cruz
2007/0084640 A1 * 4/2007 Singh ..... E21B 10/16 175/331
2007/0106487 A1 5/2007 Gavia et al.
2007/0199739 A1 8/2007 Schwefe et al.
2007/0261890 A1 11/2007 Cisneros

(56) References Cited

U.S. PATENT DOCUMENTS

| | | | |
|---|---|---|---|
| 2007/0272445 | A1 | 11/2007 | Cariveau et al. |
| 2008/0029312 | A1 | 2/2008 | Hall et al. |
| 2008/0035380 | A1 | 2/2008 | Hall et al. |
| 2008/0035387 | A1 | 2/2008 | Hall et al. |
| 2008/0099251 | A1 | 5/2008 | Hall et al. |
| 2008/0156543 | A1 | 7/2008 | McDonough et al. |
| 2008/0173482 | A1 | 7/2008 | Hall et al. |
| 2008/0179106 | A1 | 7/2008 | Gavia et al. |
| 2008/0179107 | A1 | 7/2008 | Doster |
| 2008/0179108 | A1 | 7/2008 | McClain et al. |
| 2008/0223622 | A1 | 9/2008 | Duggan et al. |
| 2008/0264695 | A1 | 10/2008 | Zahradnik et al. |
| 2008/0302575 | A1 | 12/2008 | Durairajan et al. |
| 2008/0314647 | A1 | 12/2008 | Hall et al. |
| 2009/0020339 | A1 | 1/2009 | Sherwood, Jr. |
| 2009/0051211 | A1 | 2/2009 | Hall et al. |
| 2009/0055135 | A1 | 2/2009 | Tang et al. |
| 2009/0084608 | A1 | 4/2009 | McClain et al. |
| 2009/0126998 | A1 | 5/2009 | Zahradnik et al. |
| 2009/0133938 | A1 | 5/2009 | Hall et al. |
| 2009/0145669 | A1 | 6/2009 | Durairajan et al. |
| 2009/0266619 | A1 | 10/2009 | Durairajan et al. |
| 2009/0273224 | A1 | 11/2009 | Hall |
| 2010/0065338 | A1 | 3/2010 | Hall et al. |
| 2010/0065339 | A1 | 3/2010 | Hall et al. |
| 2010/0071964 | A1 | 3/2010 | Hall et al. |
| 2010/0155149 | A1 | 6/2010 | Keshavan et al. |
| 2010/0263939 | A1 | 10/2010 | Hall et al. |
| 2010/0326740 | A1 | 12/2010 | Hall et al. |
| 2011/0042150 | A1 | 2/2011 | Hall et al. |
| 2011/0083906 | A1 | 4/2011 | Hall et al. |
| 2011/0155472 | A1 | 6/2011 | Lyons et al. |
| 2011/0192651 | A1 | 8/2011 | Lyons et al. |
| 2012/0023833 | A1 | 2/2012 | Hall et al. |
| 2012/0031674 | A1 | 2/2012 | Lyons |
| 2012/0125687 | A1 | 5/2012 | Rives |
| 2012/0205163 | A1 | 8/2012 | Azar et al. |
| 2012/0261977 | A1 | 10/2012 | Hall et al. |
| 2012/0279785 | A1 | 11/2012 | Gavia et al. |
| 2013/0199856 | A1 | 8/2013 | Bilen et al. |
| 2015/0034394 | A1 | 2/2015 | Gavia et al. |
| 2016/0230472 | A1* | 8/2016 | Bilen ..... E21B 10/5673 |

FOREIGN PATENT DOCUMENTS

| | | | |
|---|---|---|---|
| EP | 972908 | A2 | 1/2005 |
| GB | 2086451 | A | 5/1982 |

OTHER PUBLICATIONS

International Written Opinion for International Application No. PCT/US2013/025318 dated Jun. 2, 2013, 8 pages.

International Preliminary Report on Patentability for International Application No. PCT/US2013/025318 dated Aug. 12, 2014, 9 pages.

Canadian Office Action for Canadian Application No. 2864187 dated Aug. 19, 2015, 3 pages.

* cited by examiner

DRILL BITS AND EARTH-BORING TOOLS INCLUDING SHAPED CUTTING ELEMENTS AND ASSOCIATED METHODS

CROSS-REFERENCE TO RELATED APPLICATIONS

This application is a continuation of U.S. patent application Ser. No. 13/762,664, filed Feb. 8, 2013, now U.S. Pat. No. 9,316,058, issued Apr. 19, 2016, which application claims the benefit of U.S. Provisional Application Ser. No. 61/596,433, filed Feb. 8, 2012, the disclosure of each of which is hereby incorporated herein in its entirety by this reference. The subject matter of this application is related to the subject matter of U.S. Provisional Patent Application Ser. No. 61/290,401, filed Dec. 28, 2009, and to U.S. patent application Ser. No. 12/793,396 filed Jun. 3, 2010, now U.S. Pat. No. 8,505,634 issued Aug. 13, 2013. The subject matter of this application is also related to the subject matter of U.S. Provisional Patent Application Ser. No. 61/301,946, filed Feb. 5, 2010, and to U.S. patent application Ser. No. 13/022,288, filed Feb. 7, 2011, now U.S. Pat. No. 8,794,356, issued Aug. 5, 2014. The subject matter of this application is also related to the subject matter of U.S. patent application Ser. No. 13/101,840, filed May 5, 2011, now U.S. Pat. No. 8,851,207, issued Oct. 7, 2014, and to U.S. patent application Ser. No. 14/506,175, filed Oct. 3, 2014, now U.S. Pat. No. 9,200,483, issued Dec. 1, 2015. The subject matter of this application is also related to the subject matter of U.S. Provisional Patent Application Ser. No. 61/371,554, filed Aug. 6, 2010, to U.S. patent application Ser. No. 13/204,459, filed Aug. 5, 2011, now U.S. Pat. No. 9,022,149, issued May 5, 2015, and to U.S. patent application Ser. No. 14/686,093, filed Apr. 14, 2015, now U.S. Pat. No. 9,458,674, issued Oct. 4, 2016.

FIELD

Embodiments of the present disclosure relate generally to cutting elements that include a cutting tip of superabrasive material (e.g., polycrystalline diamond or cubic boron nitride) and a substrate base, to earth-boring tools including such cutting elements, and to methods of forming and using such cutting elements and earth-boring tools.

BACKGROUND

Earth-boring tools are commonly used for forming (e.g., drilling and reaming) bore holes or wells (hereinafter "wellbores") in earth formations. Earth-boring tools include, for example, rotary drill bits, core bits, eccentric bits, bicenter bits, reamers, underreamers, and mills.

Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore.

The drill bit is coupled, either directly or indirectly, to an end of what is referred to in the art as a "drill string," which comprises a series of elongated tubular segments connected end-to-end that extends into the wellbore from the surface of the formation. Often various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is attached, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The drill bit may rotate concentric with the drill string or may rotate eccentric to the drill string. For example, a device referred to as an "AKO" (Adjustable Kick Off) may be used to rotate the drill bit eccentric to the drill string.

Rolling-cutter drill bits typically include three roller cones attached on supporting bit legs that extend from a bit body, which may be formed from, for example, three bit head sections that are welded together to form the bit body. Each bit leg may depend from one bit head section. Each roller cone is configured to spin or rotate on a bearing shaft that extends from a bit leg in a radially inward and downward direction from the bit leg. The cones are typically formed from steel, but they also may be formed from a particle-matrix composite material (e.g., a cermet composite such as cemented tungsten carbide). Cutting teeth for cutting rock and other earth formations may be machined or otherwise formed in or on the outer surfaces of each cone. Alternatively, receptacles are formed in outer surfaces of each cone, and inserts fainted of hard, wear resistant material are secured within the receptacles to form the cutting elements of the cones. As the rolling-cutter drill bit is rotated within a wellbore, the roller cones roll and slide across the surface of the formation, which causes the cutting elements to crush and scrape away the underlying formation.

Fixed-cutter drill bits typically include a plurality of cutting elements that are attached to a face of bit body. The bit body may include a plurality of wings or blades, which define fluid courses between the blades. The cutting elements may be secured to the bit body within pockets formed in outer surfaces of the blades. The cutting elements are attached to the bit body in a fixed manner, such that the cutting elements do not move relative to the bit body during drilling. The bit body may be formed from steel or a particle-matrix composite material (e.g., cobalt-cemented tungsten carbide). In embodiments in which the bit body comprises a particle-matrix composite material, the bit body may be attached to a metal alloy (e.g., steel) shank having a threaded end that may be used to attach the bit body and the shank to a drill string. As the fixed-cutter drill bit is rotated within a wellbore, the cutting elements scrape across the surface of the formation and shear away the underlying formation.

Impregnated diamond rotary drill bits may be used for drilling hard or abrasive rock formations such as sandstones. Typically, an impregnated diamond drill bit has a solid head or crown that is cast in a mold. The crown is attached to a steel shank that has a threaded end that may be used to attach the crown and steel shank to a drill string. The crown may have a variety of configurations and generally includes a cutting face comprising a plurality of cutting structures, which may comprise at least one of cutting segments, posts, and blades. The posts and blades may be integrally formed with the crown in the mold, or they may be separately formed and attached to the crown. Channels separate the posts and blades to allow drilling fluid to flow over the face of the bit.

Impregnated diamond bits may be formed such that the cutting face of the drill bit (including the posts and blades) comprises a particle-matrix composite material that includes diamond particles dispersed throughout a matrix material. The matrix material itself may comprise a particle-matrix composite material, such as particles of tungsten carbide, dispersed throughout a metal matrix material, such as a copper-based alloy.

It is known in the art to apply wear-resistant materials, such as "hardfacing" materials, to the formation-engaging surfaces of rotary drill bits to minimize wear of those surfaces of the drill bits caused by abrasion. For example, abrasion occurs at the formation-engaging surfaces of an earth-boring tool when those surfaces are engaged with and sliding relative to the surfaces of a subterranean formation in the presence of the solid particulate material (e.g., formation cuttings and detritus) carried by conventional drilling fluid. For example, hardfacing may be applied to cutting teeth on the cones of roller cone bits, as well as to the gage surfaces of the cones. Hardfacing also may be applied to the exterior surfaces of the curved lower end or "shirttail" of each bit leg, and other exterior surfaces of the drill bit that are likely to engage a formation surface during drilling.

The cutting elements used in such earth-boring tools often include polycrystalline diamond cutters (often referred to as "PDCs"), which are cutting elements that include a polycrystalline diamond (PCD) material. Such polycrystalline diamond cutting elements are formed by sintering and bonding together relatively small diamond grains or crystals under conditions of high temperature and high pressure in the presence of a catalyst (such as, for example, cobalt, iron, nickel, or alloys and mixtures thereof) to form a layer of polycrystalline diamond material on a cutting element substrate. These processes are often referred to as high temperature/high pressure ("HTHP") processes. The cutting element substrate may comprise a cermet material (i.e., a ceramic-metal composite material) such as, for example, cobalt-cemented tungsten carbide. In such instances, the cobalt (or other catalyst material) in the cutting element substrate may be drawn into the diamond grains or crystals during sintering and serve as a catalyst for forming a diamond table from the diamond grains or crystals. In other methods, powdered catalyst material may be mixed with the diamond grains or crystals prior to sintering the grains or crystals together in an HTHP process.

Upon formation of a diamond table using an HTHP process, catalyst material may remain in interstitial spaces between the grains or crystals of diamond in the resulting polycrystalline diamond table. The presence of the catalyst material in the diamond table may contribute to thermal damage in the diamond table when the cutting element is heated during use due to friction at the contact point between the cutting element and the formation. Polycrystalline diamond cutting elements in which the catalyst material remains in the diamond table are generally thermally stable up to a temperature of about 750° Celsius, although internal stress within the polycrystalline diamond table may begin to develop at temperatures exceeding about 350° Celsius. This internal stress is at least partially due to differences in the rates of thermal expansion between the diamond table and the cutting element substrate to which it is bonded. This differential in thermal expansion rates may result in relatively large compressive and tensile stresses at the interface between the diamond table and the substrate, and may cause the diamond table to delaminate from the substrate. At temperatures of about 750° Celsius and above, stresses within the diamond table may increase significantly due to differences in the coefficients of thermal expansion of the diamond material and the catalyst material within the diamond table itself. For example, cobalt thermally expands significantly faster than diamond, which may cause cracks to form and propagate within the diamond table, eventually leading to deterioration of the diamond table and ineffectiveness of the cutting element.

In order to reduce the problems associated with different rates of thermal expansion in polycrystalline diamond cutting elements, so-called "thermally stable" polycrystalline diamond (TSD) cutting elements have been developed. Such a thermally stable polycrystalline diamond cutting element may be formed by leaching the catalyst material (e.g., cobalt) out from interstitial spaces between the diamond grains in the diamond table using, for example, an acid. All of the catalyst material may be removed from the diamond table, or only a portion may be removed. Thermally stable polycrystalline diamond cutting elements in which substantially all catalyst material has been leached from the diamond table have been reported to be thermally stable up to a temperature of about 1200° Celsius. It has also been reported, however, that such fully leached diamond tables are relatively more brittle and vulnerable to shear, compressive, and tensile stresses than are non-leached diamond tables. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which only a portion of the catalyst material has been leached from the diamond table.

BRIEF SUMMARY

In some embodiments, a cutting element for an earth-boring tool of the present disclosure includes a substrate base and a cutting tip. The substrate base includes a substantially cylindrical outer side surface and a longitudinal axis substantially parallel to the substantially cylindrical outer side surface. The cutting tip includes an elongated surface defining a longitudinal end of the cutting tip, a first generally conical surface extending from proximate the substrate base to the elongated surface, and a second generally conical surface extending from proximate the substrate base to the elongated surface, the second generally conical surface opposite the first generally conical surface. The cutting tip also includes a first generally flat surface extending between the first generally conical surface, the second generally conical surface, and the elongated surface; and a second generally flat surface extending between the first generally conical surface, the second generally conical surface, and the elongated surface, the second generally flat surface opposite the first generally flat surface. A central axis of the cutting tip extends through the cutting tip from an interface between the substrate base and the cutting tip to a central location on the elongated surface. The longitudinal axis of the substrate base is not co-linear with the central axis of the cutting tip.

In other embodiments, the present disclosure includes a cutting element for an earth-boring tool that includes a substantially cylindrical substrate base and a cutting tip secured to the substrate base. The cutting tip includes a first generally conical surface extending from proximate the substrate base toward a longitudinal end of the cutting tip and an opposing second generally conical surface extending from proximate the substrate base toward the longitudinal end of the cutting tip. The cutting tip also includes a first flank surface extending between the first generally conical surface and the second generally conical surface and extending from proximate the substrate base toward the longitudinal end of the cutting tip and an opposing second flank surface extending between the first generally conical surface and the second generally conical surface and extending from proximate the substrate base toward the longitudinal end of the cutting tip. A surface defining the longitudinal end of the cutting tip is relatively more narrow in a central region thereof than in a radially outer region thereof.

In additional embodiments, the present disclosure includes an earth-boring tool including a body and a plurality of cutting elements attached to the body. Each of the cutting elements includes a substantially cylindrical substrate base and a cutting tip. The cutting tip of each cutting element includes a first generally conical surface extending from proximate the substrate base to a longitudinal end of the cutting tip and a second generally conical surface extending from proximate the substrate base to the longitudinal end of the cutting tip, the second generally conical surface opposite the first generally conical surface relative to a longitudinal axis of the cutting tip. Each cutting tip also includes a first flank surface extending from proximate the substrate base to the longitudinal end of the cutting tip and extending between the first generally conical surface and the second generally conical surface and a second flank surface extending from proximate the substrate base to the longitudinal end of the cutting tip and extending between the first generally conical surface and the second generally conical surface, the second flank surface opposite the first flank surface relative to a longitudinal axis of the cutting tip. At least one of the cutting elements is oriented relative to the body of the earth-boring tool such that the cutting tip of the at least one cutting element is back raked and configured to initially engage a formation to be bored by the earth-boring tool with one of the first generally conical surface and the second generally conical surface of the at least one cutting element.

DETAILED DESCRIPTION

The illustrations presented herein are not meant to be actual views of any particular cutting element, earth-boring tool, or portion of a cutting element or tool, but are merely idealized representations that are employed to describe embodiments of the present disclosure. Additionally, elements common between figures may retain the same numerical designation.

As used herein, the term "earth-boring tool" means and includes any tool used to remove formation material and form a bore (e.g., a wellbore) through a formation by way of the removal of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools.

As used herein, the term "substantially" means to a degree that one skilled in the art would understand the given parameter, property, or condition is met with a small degree of variance, such as within acceptable manufacturing tolerances. For example, a parameter that is "substantially" met may be at least about 90% met, at least about 95% met, or even at least about 99% met.

As used herein, any relational term, such as "first," "second," "over," "under," "on," "underlying," "end," etc., is used for clarity and convenience in understanding the disclosure and accompanying drawings and does not connote or depend on any specific preference, orientation, or order, except where the context clearly indicates otherwise.

Figure 1:
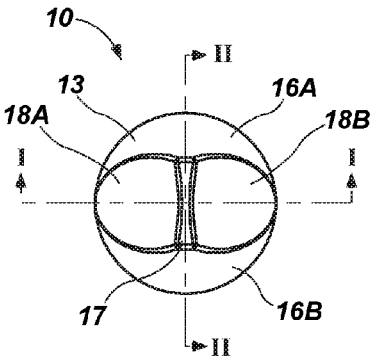
FIG. 1 is a top plan view of a cutting element according to an embodiment of the present disclosure.
Figure 2:
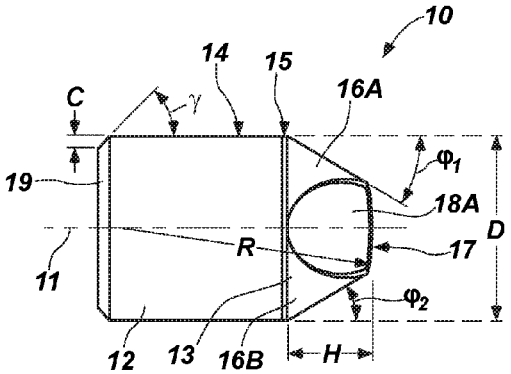
FIG. 2 is a side plan view of the cutting element of FIG. 1.
Figure 3:
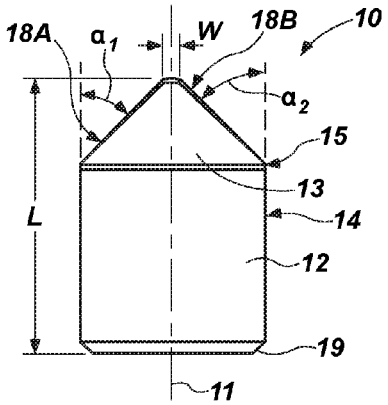
FIG. 3 is a side plan view of the cutting element of FIG. 1 taken from a direction perpendicular to the view of FIG. 2.
Figure 4:
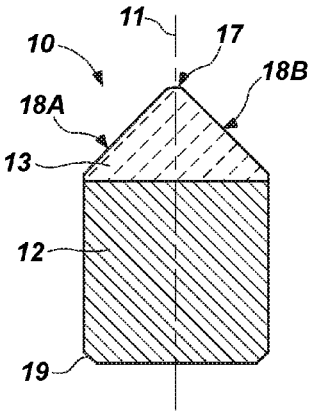
FIG. 4 is a cross-sectional view of the cutting element of FIG. 1 taken from line I-I of FIG. 1.
Figure 5:
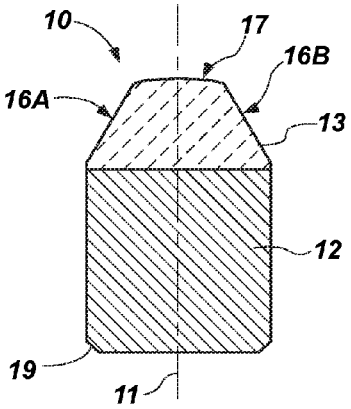
FIG. 5 is a cross-sectional view of the cutting element of FIG. 1 taken from line II-II of FIG. 1.

FIGS. 1-4 and 5 show various views of a cutting element 10 according to an embodiment of the present disclosure. In particular, FIG. 1 is a top plan view of the cutting element 10, FIG. 2 is a side plan view of the cutting element 10, FIG. 3 is a side plan view of the cutting element 10 taken from a direction perpendicular to the view of FIG. 2, FIG. 4 is a cross-sectional view of the cutting element 10 taken from line I-I of FIG. 1, and FIG. 5 is a cross-sectional view of the cutting element 10 taken from line II-II of FIG. 1.

Referring to FIGS. 1-4 and 5, the cutting element 10 may include a longitudinal axis 11, a substrate base 12, and a cutting tip 13. The substrate base 12 may have a generally cylindrical shape. The longitudinal axis 11 may extend through a center of the substrate base 12 in an orientation that may be at least substantially parallel to a lateral side surface 14 of the substrate base 12 (e.g., in an orientation that may be perpendicular to a generally circular cross-section of the substrate place 12). The lateral side surface 14 of the substrate base 12 may be coextensive and continuous with a generally cylindrical lateral side surface 15 of the cutting tip 13 (see FIGS. 2 and 3). The cutting element 10, including the substrate base 12 and the cutting tip 13, may have an outer diameter D and a longitudinal length L, as shown in FIGS. 2 and 3, respectively. By way of example and not limitation, the outer diameter D may be between about 0.40 inch (1.016 cm) and about 0.55 inch (1.397 cm), and the longitudinal length L may be between about 0.5 inch (1.27 cm) and about 1.0 inch (2.54 cm). In one embodiment, the longitudinal length L of the cutting element 10 may be about 0.760 inch (1.930 cm). However, it is to be understood that the entire cutting element 10 may be larger or smaller in the diameter D and/or the longitudinal length L, as well as in other dimensions described herein, depending on an application in which the cutting element 10 is to be used, as will be recognized by one of ordinary skill in the art. Thus, the overall size of the cutting element 10 may be tailored for a given application and is not limited to the ranges or specific dimensions described herein by way of example.

The cutting tip 13 may also include a first generally conical surface 16A, a second generally conical surface 16B, a longitudinal end 17, a first generally flat (i.e., planar) surface 18A, and a second generally flat (i.e., planar) surface 18B. In some embodiments, the surfaces 18A and 18B may be at least substantially flat (i.e., planar), although, in other embodiments, the surfaces 18A and 18B may be textured and/or curved, as is explained in more detail below. The first and second surfaces 18A and 18B are also somewhat more generally referred to herein as the first flank surface 18A and the second flank surface 18B, respectively. The first generally conical surface 16A may be defined by an angle $\phi_1$ existing between the first generally conical surface 16A and a phantom line extending from the generally cylindrical lateral side surface 15 of the cutting tip 13 (FIG. 2). By way of example and not limitation, the angle $\phi_1$ may be within a range of from about zero degrees (0°) to about thirty-five degrees (35°). In one embodiment, the angle $\phi_1$ may be about thirty degrees (30°). The first generally conical surface 16A may extend from the generally cylindrical lateral side surface 15 to the longitudinal end 17, and may extend to edges of the first generally flat surface 18A and of the second generally flat surface 18B. The second generally conical surface 16B may be defined by an angle $\phi_2$ existing between the second generally conical surface 16B and a phantom line extending from the generally cylindrical lateral side surface 15 of the cutting tip 13 (FIG. 2). By way of example and not limitation, the angle $\phi_2$ may be within a range of from about zero degrees (0°) to about thirty-five degrees (35°). The second generally conical surface 16B may extend from the generally cylindrical lateral side surface 15 to the longitudinal end 17, and may extend to the edges of the first generally flat surface 18A and of the second generally flat surface 18B opposite the first generally conical surface 16A. In some embodiments, the first and second generally conical surfaces 16A and 16B may be generally co-conical and may be oriented generally symmetrically with respect to each other about the longitudinal axis 11 of the cutting element 10. Depending on the physical extent of the first and second generally flat surfaces 18A and 18B, the first and second generally conical surfaces 16A and 16B may be coextensive, in some embodiments.

The cutting tip 13 may have a height H (FIG. 2) from a base of the first and second generally conical surfaces 16A and 16B to the longitudinal end 17. In some embodiments, the height H may have a length between about 35 and about 75% of the length of the diameter D. By way of example and not limitation, the height H may be between about 0.2 inch (5.08 mm) and about 0.3 inch (7.62 mm). In one embodiment, the height H may be about 0.235 inch (5.969 mm), for example.

The location of the longitudinal end 17 may be centered about and extend generally symmetrically outward from the longitudinal axis 11, as shown in FIGS. 1, 2, and 5. The longitudinal end 17 may extend between the first and second generally conical surfaces 16A and 16B and between the first and second generally flat surfaces 18A and 18B along a vertex of the cutting tip 13. As shown in FIG. 1, the longitudinal end 17 may be defined by an elongated surface. The longitudinal end 17 may have a generally arcuate shape with a radius R centered along the longitudinal axis 11, as shown in FIG. 2. By way of example and not limitation, the radius R may be between about 0.425 inch (1.080 cm) and about 4.0 inches (10.16 cm). In one embodiment, the radius R may be about 0.7 inch (1.778 cm), for example. The generally arcuate shape of the longitudinal end 17 when viewed from the perspective of FIG. 2 may cause the elongated surface defining the longitudinal end 17 to be relatively more narrow in a central region thereof than in a radially outer region thereof, as shown in FIG. 1. The first generally flat surface 18A may extend from a location at least substantially proximate the longitudinal end 17 to a location on the cutting element 10 at a selected or predetermined distance from the longitudinal end 17, such that an angle $\alpha_1$ between the longitudinal axis 11 and the first generally flat surface 18A may be within a range of from about fifteen degrees (15°) to about ninety degrees (90°) (FIG. 3). In some embodiments, the angle $\alpha_1$ may be between about forty-five degrees (45°) and about sixty degrees (60°). In one embodiment, the angle $\alpha_1$ may be about forty-five degrees (45°), for example. The first generally flat surface 18A may extend from the generally cylindrical side surface 15 (or proximate thereto) to the longitudinal end 17 (or proximate thereto). The second generally flat surface 18B may be oriented substantially symmetrically about the longitudinal axis 11 from the first generally flat surface 18A. Thus, the second generally flat surface 18B may extend from a location at least substantially proximate the longitudinal end 17 to a location on the cutting element 10 at a selected or predetermined distance from the longitudinal end 17, such that an angle $\alpha_2$ between the longitudinal axis 11 and the second substantially flat surface 18B may be within a range of from about fifteen degrees (15°) to about ninety degrees (90°) (FIG. 3). In some embodiments, the angle $\alpha_2$ may be between about forty-five degrees (45°) and about sixty degrees (60°). In one embodiment, the angle $\alpha_2$ may be about forty-five degrees (45°), for example. The second generally flat surface 18B may extend from the generally cylindrical side surface 15 (or proximate thereto) to the longitudinal end 17 (or proximate thereto). A surface defining the longitudinal end 17 may extend between a longitudinal extent of the first and second generally flat surfaces 18A and 18B. The surface defining the longitudinal end 17 may have a width W (FIG. 3). In some embodiments, the width W may be between about 0% and about 50% of the diameter D. For example, in some embodiments, the width W may be between about 0% and about 12% of the diameter D. By way of example and not limitation, the width W may be between about 0 inches (0 cm) and about 0.042 inch (1.067 mm). In one embodiment, the width W may be about 0.035 inch (0.889 mm), for example. In another embodiment, the width W may be about 0.010 inch (0.254 mm), for example.

As can be seen in the cross-sectional views of FIGS. 4 and 5, substantially all of the cutting element 10 from an interface between a longitudinal end of the substrate base 12 to the longitudinal end 17 of the cutting tip 13 may comprise a substantially uniform material. In some embodiments (not shown), the substrate base 12 may include one or more protrusions extending longitudinally into the cutting tip 13 and the cutting tip 13 may include one or more recesses complementary to the one or more protrusions to mechanically strengthen a bond between the substrate base 12 and the cutting tip 13. The cutting tip 13 may comprise an abrasion resistant material. Abrasion resistant materials useful in drilling formations are known and are, therefore, not described herein in detail. However, by way of example and not limitation, the cutting tip 13 may include one or more of a polycrystalline diamond (PCD) material (with or without a catalyst material), a carbide material, a composite material (e.g., a metal-matrix carbide composite material), a material comprising cubic boron nitride, etc. The cutting tip 13 may be formed separate from or together with the substrate base 12 in an HTHP process, for example. If the cutting tip 13 is formed separate from the substrate base 12, the cutting tip 13 and the substrate base 12 may be attached together after being individually formed, such as by brazing, soldering, adhering, mechanical interference, etc.

The substrate base 12 may be formed from a material that is relatively hard and resistant to wear. As one non-limiting example, the substrate base 12 may be at least substantially comprised of a cemented carbide material, such as cobalt-cemented tungsten carbide.

The substrate base 12 may include a chamfer 19 around a longitudinal end thereof opposite the cutting tip 13. The chamfer 19 may be defined by an angle $\gamma$ from the lateral side surface 14 of the substrate base 12 to a phantom line generally parallel to the surface of the chamfer 19, as shown in FIG. 2. In one embodiment, the angle $\gamma$ of the chamfer 19 may be about forty-five degrees (45°), for example. The chamfer 19 may also be defined by a radial distance C between a radially outer edge of a longitudinal end surface of the substrate base 12 on one side of the chamfer 19 and the lateral side surface 14 of the substrate base 12 on the other side of the chamfer 19. By way of example and not limitation, the distance C may be between about 0.025 inch (0.635 mm) and about 0.035 inch (0.889 mm). In one embodiment, the distance C may be about 0.030 inch (0.762 mm), for example.

Figure 4A:
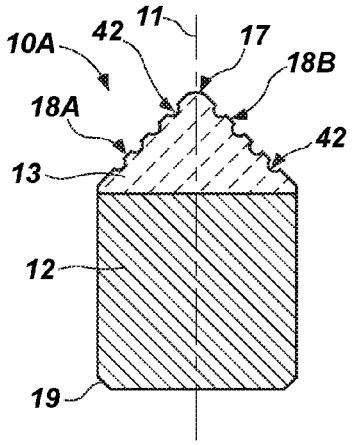
FIG. 4A is a cross-sectional view of a cutting element according to another embodiment of the present disclosure, showing valleys extending into a cutting tip thereof.

Although the first and second generally flat surfaces 18A and 18B are shown in FIGS. 1-4 and 5 and described as generally planar, the present disclosure is not so limited. In some embodiments, the first and second generally flat surfaces 18A and 18B may include at least one of a ridge thereon and a valley therein. For example, as shown in FIG. 4A, a cutting element 10A may include first and second generally flat surfaces 18A and 18B having one or more valleys 42 (i.e., indentations, recesses) formed therein. The one or more valleys 42 may extend into the cutting tip 13 from the first and second generally flat surfaces 18A and 18B. The one or more valleys 42 may have any cross-sectional shape, such as, for example, arcuate (as shown in FIG. 4A), triangular, rectangular, trapezoidal, or irregular. As shown in FIG. 4A, the one or more valleys 42 may extend across the first and second generally flat surfaces 18A and 18B in a direction generally parallel to the length of the longitudinal end 17 of the cutting tip 13. In other words, the one or more valleys 42 may extend in a direction generally perpendicular to the longitudinal axis 11 of the cutting element 10A. In other embodiments, the one or more valleys 42 may extend along the first and second generally flat surfaces 18A and 18B in a direction generally from the longitudinal end 17 of the cutting tip 13 toward the substrate base 12. In other words, the one or more valleys 42 may extend in a direction generally parallel to a plane of the cross-section shown in FIG. 4A. It yet further embodiments, the one or more valleys 42 may extend in another direction that is angled relative to the length of the longitudinal end 17 of the cutting tip 13.

Figure 4B:
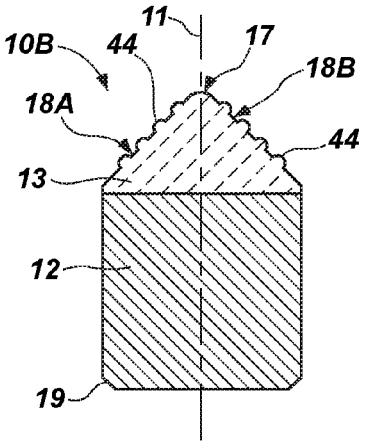
FIG. 4B is a cross-sectional view of a cutting element according to another embodiment of the present disclosure, showing ridges extending from a cutting tip thereof.

By way of another example, as shown in FIG. 4B, a cutting element 10B may include first and second generally flat surfaces 18A and 18B having one or more ridges 44 (i.e., protrusions) formed thereon. As shown in FIG. 4B, the one or more ridges 44 may extend away from the first and generally flat surfaces 18A and 18B of the cutting tip 13. The one or more ridges 44 may have any cross-sectional shape, such as, for example, arcuate (as shown in FIG. 4B), triangular, rectangular, trapezoidal, or irregular. As shown in FIG. 4B, the one or more ridges 44 may extend across the first and second generally flat surfaces 18A and 18B in a direction generally parallel to a length of the longitudinal end of the cutting tip 13. In other words, the one or more ridges 44 may extend in a direction generally perpendicular to the longitudinal axis 11 of the cutting element 10B. In other embodiments, the one or more ridges 44 may extend along the first and second generally flat surfaces 18A and 18B in a direction generally from the longitudinal end 17 of the cutting tip 13 toward the substrate base 12. In other words, the one or more ridges 44 may extend in a direction generally parallel to a plane of the cross-section shown in FIG. 4B. In yet further embodiments, the one or more ridges 44 may extend in another direction that is angled relative to the length of the longitudinal end 17 of the cutting tip 13.

Figure 4C:
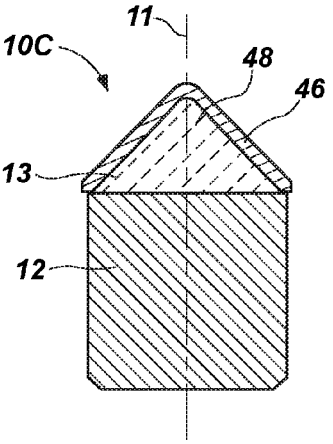
FIG. 4C is a cross-sectional view of a cutting element according to another embodiment of the present disclosure, showing a cutting tip thereof formed of multiple materials.

Furthermore, although the cutting tip 13 has been described as comprising a substantially uniform material, the present disclosure is not so limited. For example, the cutting tip 13 may comprise a plurality of different materials, as shown in FIG. 4C. For example, the cutting tip 13 of a cutting element 10C may include a carbide material 46 formed over a PCD material 48, which may be useful for some applications, such as drilling through a casing material with the carbide material 46 and continuing to drill through a formation past the casing material with the PCD material 48 as the carbide material 46 wears away. Thus, one of ordinary skill in the art will, upon consideration of the present disclosure, appreciate that the possible compositions and forms of the cutting tip 13 are not limited to the particular compositions and forms shown in the figures of the present disclosure.

Figure 4D:
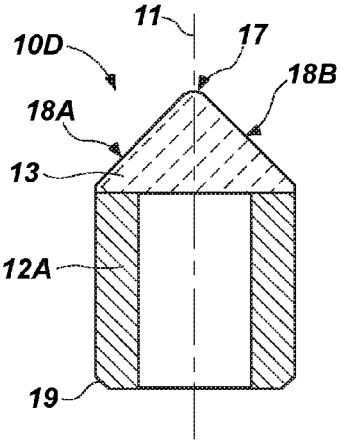
FIG. 4D is a cross-sectional view of a cutting element according to another embodiment of the present disclosure, showing a hollow substrate base thereof.

Referring to FIG. 4D, a cutting element 10D according to another embodiment of the present disclosure may include a cutting tip 13 coupled (e.g., attached, mounted, adhered, etc.) to a substrate base 12A that is substantially hollow. In some embodiments, the substantially hollow substrate base 12A may be fully or partially filled with a material that is different than the material of the substrate base 12A, such as a material that is cheaper, softer, lighter weight, etc., relative to the material of the substrate base 12A. In other embodiments, the substantially hollow substrate base 12A may be used without any solid material disposed therein.

Figure 6:
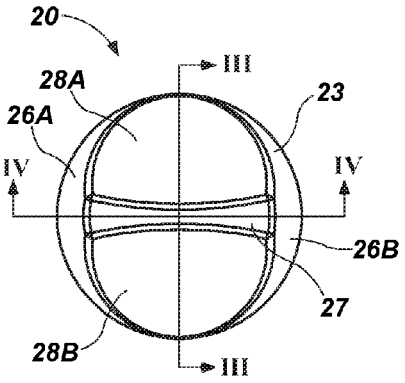
FIG. 6 is a top plan view of a cutting element according to another embodiment of the present disclosure.
Figure 7:
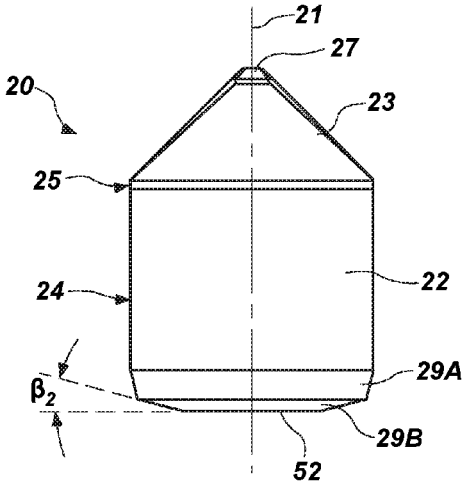
FIG. 7 is a side plan view of the cutting element of FIG. 6.
Figure 8:
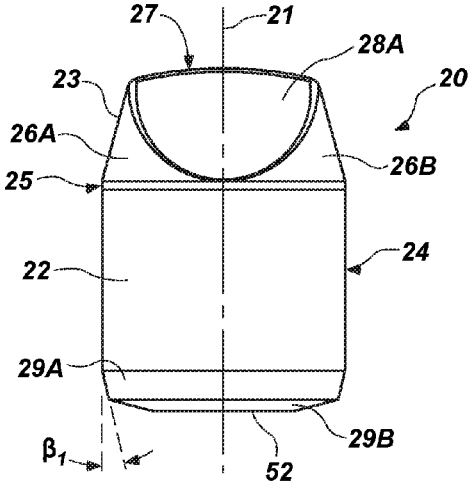
FIG. 8 is a side plan view of the cutting element of FIG. 6 taken from a direction perpendicular to the view of FIG. 7.
Figure 9:
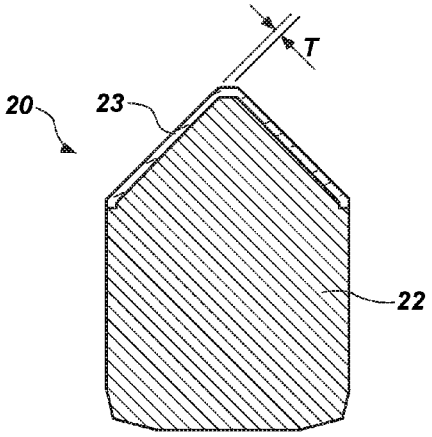
FIG. 9 is a cross-sectional view of the cutting element of FIG. 6 taken from line III-III of FIG. 6.
Figure 10:
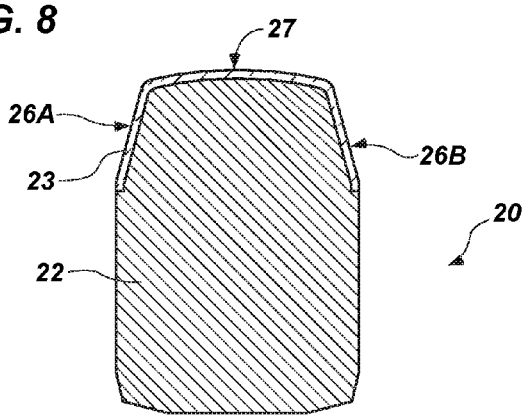
FIG. 10 is a cross-sectional view of the cutting element of FIG. 6 taken from line IV-IV of FIG. 6.

FIGS. 6-10 show various views of a cutting element 20 according to another embodiment of the present disclosure. In particular, FIG. 6 is a top plan view of the cutting element 20, FIG. 7 is a side plan view of the cutting element of FIG. 6, FIG. 8 is a side plan view of the cutting element of FIG. 6 taken from a direction perpendicular to the view of FIG. 7, FIG. 9 is a cross-sectional view of the cutting element of FIG. 6 taken from line III-III of FIG. 6, and FIG. 10 is a cross-sectional view of the cutting element of FIG. 6 taken from line IV-IV of FIG. 6.

Referring to FIGS. 6-10, the cutting element 20 may include a longitudinal axis 21, a substrate base 22, and a cutting tip 23. The substrate base 22 may have a generally cylindrical shape. The longitudinal axis 21 may extend through a center of the substrate base 22 in an orientation that may be at least substantially parallel to a lateral side surface 24 of the substrate base 22 (e.g., in an orientation that may be perpendicular to a generally circular cross-section of the substrate base 22). The lateral side surface 24 of the substrate base 22 may be coextensive and continuous with a generally cylindrical lateral side surface 25 of the cutting tip 23 (FIGS. 7 and 8). The cutting tip 23 also includes a first generally conical surface 26A, a second generally conical surface 26B, a longitudinal end 27, a first generally flat surface 28A, and a second generally flat surface 28B. The exposed shape, dimensions, and material properties of each of the cutting tip 23, the first generally conical surface 26A, the second generally conical surface 26B, the longitudinal end 27, the first generally flat surface 28A, and the second generally flat surface 28B may be substantially as described above with reference to the respective cutting tip 13, the first generally conical surface 16A, the second generally conical surface 16B, the longitudinal end 17, the first generally flat surface 18A, and the second generally flat surface 18B described above with reference to FIGS. 1-5, except for the differences that will be described below. For example, the angles, lengths, and relative orientations of the various portions of the cutting element 20 of FIGS. 6-10 may generally be within the ranges discussed with reference to the various portions of the cutting element 10 of FIGS. 1-5.

The cutting tip 23 of the cutting element 20 may be formed as a relatively thin layer over the substrate base 22, as shown in the cross-sectional views of FIGS. 9 and 10. Material of the cutting tip 23 may be formed to have a thickness T that is substantially uniform over the underlying substrate base 22. By way of example and not limitation, the thickness T of the material of the cutting tip 23 may be at least about 0.15 inch (3.81 mm). A longitudinal end of the substrate base 22 underlying the cutting tip 23 may include a protrusion that is in approximately the same shape as the cutting tip 23, except that the longitudinal end of the substrate base 22 may be smaller than the exterior of the cutting tip 23 by the thickness T. The substrate base 22 may be formed in the shape shown, and the material of the cutting tip 23 may be formed over the substrate base 22 through, for example, an HTHP process. Such a configuration may reduce the amount of material used to form the cutting tip 23, which may reduce the cost of forming the cutting element 20.

A longitudinal end 52 of the substrate base 22 opposite the cutting tip 23 may include a first chamfer 29A and a second chamfer 29B, as shown in FIGS. 7 and 8. The first chamfer 29A may extend around the substrate base 22 between the lateral side surface 24 of the substrate base 22 and the second chamfer 29B. The second chamfer 29B may extend around the substrate base 22 between the first chamfer 29A and the longitudinal end 52 of the substrate base 22. The first chamfer 29A may be defined by an angle $\beta_1$ that exists between a phantom line extending from the lateral side surface 24 and a phantom line parallel to the surface of the first chamfer 29A. By way of example and not limitation, the angle $\beta_1$ may be between about 10° and about 16°, such as about 13°. The second chamfer 29B may be defined by an angle $\beta_2$ that exists between a phantom line extending from a plane of the longitudinal end 52 of the substrate base 22 and a phantom line parallel to the surface of the second chamfer 29B. By way of example and not limitation, the angle $\beta_2$ may be between about 10° and about 20°, such as about 15°.

Figure 11:
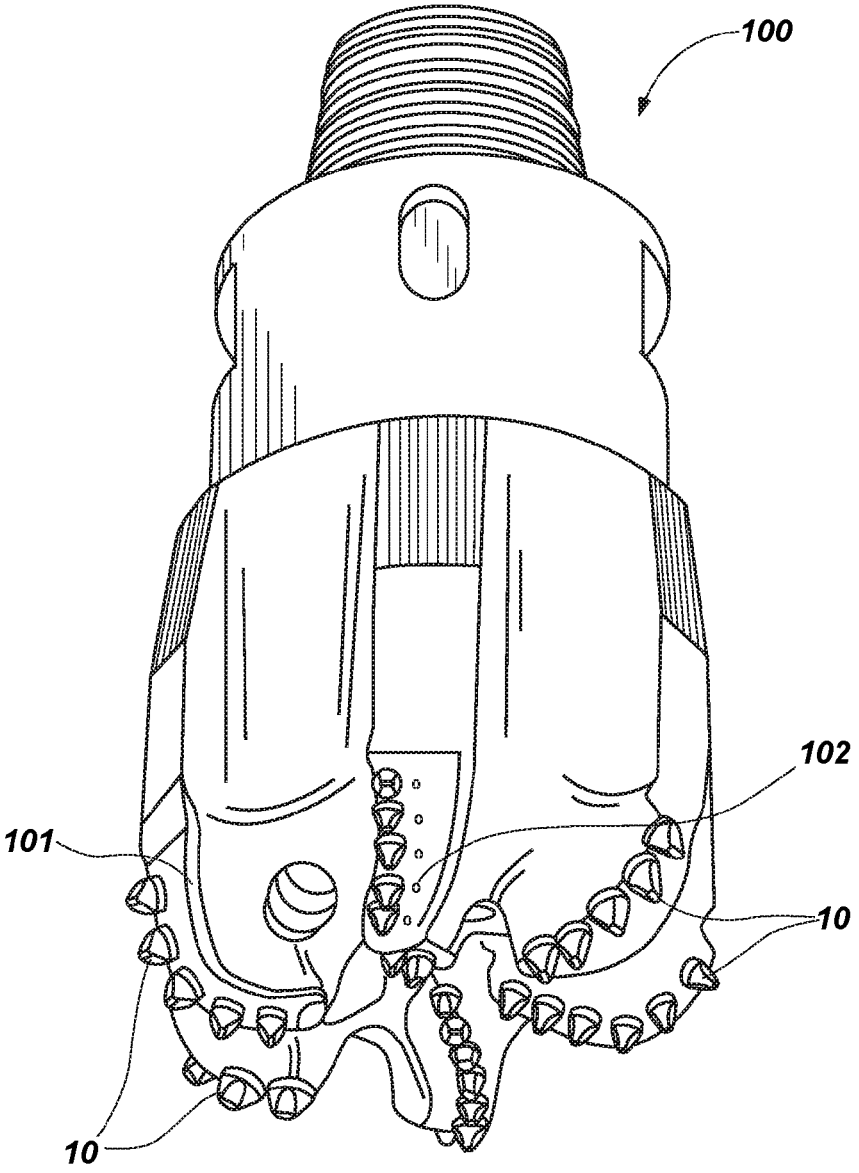
FIG. 11 is a simplified perspective view of an embodiment of a fixed-cutter earth-boring rotary drill bit of the present disclosure that includes cutting elements as described herein.

Each of the cutting elements 10 and 20 may be attached to an earth-boring tool such that the respective cutting tips 13 and 23 will contact a surface of a subterranean formation within a wellbore during a drilling or reaming process. FIG. 11 is a simplified perspective view of a fixed-cutter earth-boring rotary drill bit 100, which includes a plurality of the cutting elements 10 attached to blades 101 on a body of the drill bit 100. In additional embodiments, the drill bit 100 may include both cutting elements 10 and cutting elements 20. In yet further embodiments, the drill bit 100 may include only cutting elements 20. Although not shown, it is to be understood that the cutting elements 10 and/or 20 may be positioned on a rolling-cutter drill bit, such as a tricone bit, or an earth-boring tool of another type (e.g., a reamer). The cutting elements 10 or 20 may be aligned with an alignment feature 102 formed on or in the body of the drill bit 100 to ensure proper rotation of the cutting tips 13 or 23 (see FIGS. 1-10) of the cutting elements 10 or 20 relative to the drill bit 100 and the formation to be drilled. In some embodiments, the alignment feature 102 may be a hole, a bump, a groove, a mark, or any other feature that can be discerned with which to align the cutting tips 13 or 23. In other embodiments, an alignment feature may be formed within pockets in which the cutting elements 10 or 20 are to be positioned. The cutting elements 10 or 20 may be visually aligned with the alignment feature(s) 102 upon attachment to the body of the drill bit 100, or the cutting elements 10 or 20 may include a feature or shape complementary to the alignment feature(s) 102 for mechanical alignment therewith (i.e., if the alignment feature 102 is formed in a pocket). Further, earth-boring tools may include one or more cutting elements as described herein, and may also include other types of cutting elements. In other words, one or more cutting elements as described herein may be employed on an earth-boring tool in combination with other types of cutting elements such as conventional shearing PDC cutting elements having a generally cylindrical shape with a flat cutting face on an end thereof.

Figure 12:
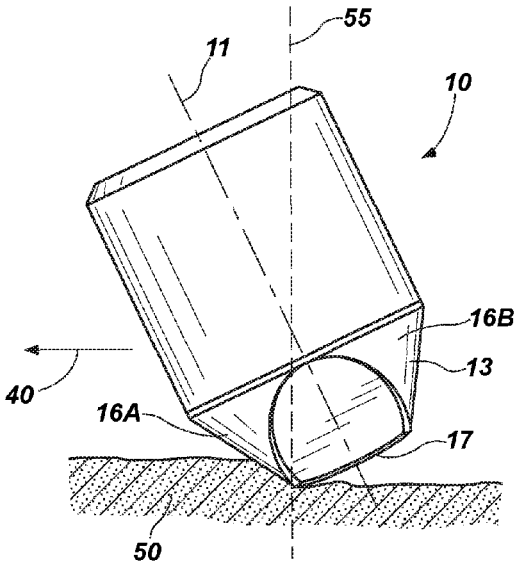
FIG. 12 is a simplified side view of the cutting element of FIG. 1 as it is cutting through a formation during operation thereof.

FIG. 12 is a simplified side view of the cutting element 10 as it is cutting through a formation 50 during operation thereof. The drill bit body and other components are removed from the view of FIG. 12 for clarity and convenience.

Referring to FIG. 12 in conjunction with FIG. 11, during operation, the cutting element 10 may move relative to the formation 50 in a direction 40 as the cutting element 10 cuts through the formation 50. In some embodiments, the cutting element 10 may be positioned on a drill bit such that the longitudinal axis 11 thereof is angled with respect to a phantom line 55 extending normal to a surface of the formation 50 through which the cutting element 10 is configured to cut. As shown in FIG. 12, the cutting element 10 may be angled such that the first generally conical surface 16A engages with the formation 50 prior to the longitudinal end 17 of the cutting element 10 in the direction 40 of movement of the cutting element 10. In other words, the cutting element 10 may be oriented at a back rake angle with respect to the formation 50. In other embodiments, however, the cutting element 10 may be oriented at a forward rake angle with respect to the formation 50 (i.e., the longitudinal axis 11 of the cutting element 10 being oriented relative to the phantom line 55 opposite to the orientation shown in FIG. 12), or may be oriented with a neutral rake angle perpendicular to the formation 50 (i.e., the longitudinal axis 11 of the cutting element 10 being at least substantially parallel to the phantom line 55).

Figure 13A:
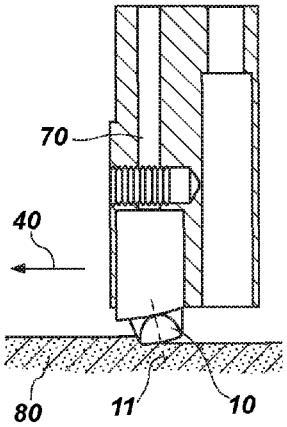
FIG. 13A is a simplified side view of a test fixture including the cutting element of FIG. 1 oriented therein at a back rake angle.
Figure 13B:
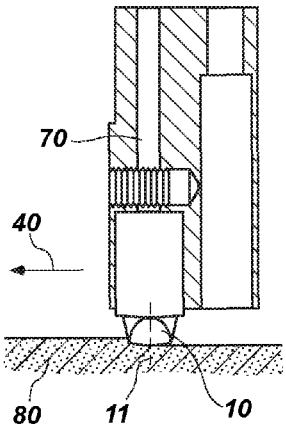
FIG. 13B is a simplified side view of a test fixture including the cutting element of FIG. 1 oriented therein at a neutral rake angle.
Figure 13C:
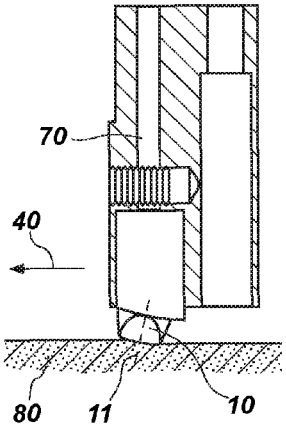
FIG. 13C is a simplified side view of a test fixture including the cutting element of FIG. 1 oriented therein at a forward rake angle.

The shape of the cutting element 10 of the present disclosure and the orientation thereof relative to the formation 50 may provide improvements when compared to the conventional cutting elements. FIGS. 13A-13C show simplified side views of a test fixture 70 including the cutting element 10 oriented therein with various rake angles. The cutting element 10 was moved in the direction 40 relative to a test sample of formation material 80, a planar surface of which was positioned generally horizontally when viewed in the perspective of FIGS. 13A-13C.

As shown in FIG. 13A, the cutting element 10 was oriented in the text fixture 70 such that the cutting element 10 was back raked relative to the test sample of formation material 80, the cutting element 10 was caused to engage with the test sample of formation material 80, and various parameters (e.g., tangential force, axial force, cutting efficiency, formation fracture, flow of cuttings, etc.) were observed during and after the test. Similarly, as shown in FIGS. 13B and 13C, the cutting element 10 was oriented in the text fixture 70 such that the cutting element 10 was neutrally raked and forward raked, respectively, and the various parameters measured and compared to the results of the test with the back raked cutting element 10 (FIG. 13A). Such tests suggested that, considering the various parameters, back raking the cutting element 10 (as in FIG. 13A) provided the greatest durability and drilling efficiency, among other improvements, compared to the neutrally raked and forward raked configurations. Therefore, although the shape and other characteristics of the cutting element 10 of the present disclosure may provide improvements over prior known cutting elements regardless of the raking angle thereof, back raking the cutting element 10 may provide additional improvements in at least some drilling applications when compared to other raking angles and when compared to prior known cutting elements.

Figure 14:
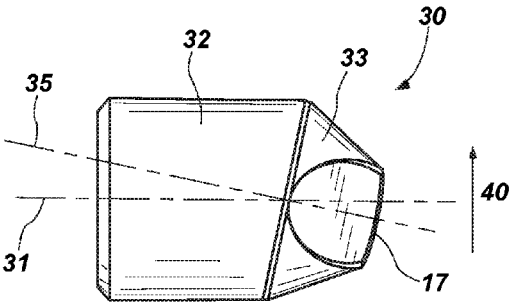
FIG. 14 is a side plan view of a cutting element according to another embodiment of the present disclosure, showing a cutting tip thereof that is angled relative to a substrate base thereof.

FIG. 14 is a side plan view of a cutting element 30 according to another embodiment of the present disclosure. The cutting element 30 may include a substrate base 32 and a cutting tip 33 that are, in most aspects, at least substantially similar to one or both of the substrate bases 12 and 22 and one or both of the cutting tips 13 and 23, respectively, described above. However, the substrate base 32 may have a longitudinal axis 31 as described above and the cutting tip 33 may have a longitudinal axis 35. The longitudinal axis 35 of the cutting tip 33 may extend generally centrally through the cutting tip 33 from (e.g., perpendicular to) an interface between the cutting tip 33 and the substrate base 32 to a central location on the longitudinal end 17 of the cutting tip 33. The longitudinal axis 31 of the substrate base 32 and the longitudinal axis 35 of the cutting tip 33 are not co-linear, as shown in FIG. 14. Thus, the substrate base 32 of the cutting element 30 may be at least partially positioned within a cutter pocket of a drill bit body in an orientation, and the cutting tip 33 of the cutting element 30 may be angled with respect to the orientation. Thus, the back raking of the cutting element 30 may be provided simply by the geometrical configuration thereof, rather than positioning the entire cutting element 30 at a predetermined rake angle relative to the drill bit body. For example, if the cutting element 30 is moved relative to a formation in a direction 40 that is generally perpendicular to the longitudinal axis 31 of the substrate base 32, the cutting tip 33 may be back raked relative to the formation by the same angle of difference between the longitudinal axis 31 of the substrate base 32 and the longitudinal axis 35 of the cutting tip 33.

Due to the relative angle between the generally cylindrical substrate base 32 and the cutting tip 33, the interface between the substrate base 32 and the cutting tip 33 may generally be circumscribed by an oval.

Figure 15:
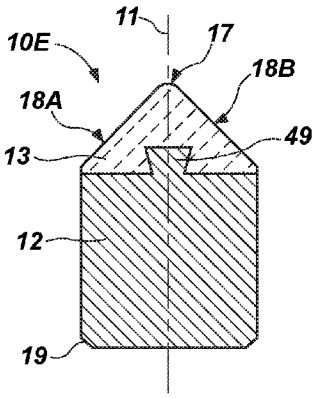
FIG. 15 is a cross-sectional view of a cutting element according to another embodiment of the present disclosure, showing a cutting tip thereof that is rotatable relative to a substrate base thereof.

In some embodiments, at least a portion of the cutting element 10, 20, 30 may be free to at least partially rotate about the axis 11, 21, 31 thereof during operation of a drill bit including the cutting element 10, 20, 30. By way of example, the cutting tip 13 of a cutting element 10E may be configured to rotate about the longitudinal axis 11 relative to the substrate base 12, as shown in FIG. 15. In such embodiments, the substrate base 12 and/or the cutting tip 13 may include one or more engagement features 49 (e.g., a post, a recess, a ridge, a bearing, etc.) configured to hold the cutting tip 13 onto the substrate base 12, while allowing the cutting tip 13 to rotate relative to the substrate base 12 about the longitudinal axis 11. In such embodiments, the cutting tip 13 may be capable of self-alignment within a groove cut into a formation during operation of the drill bit. By way of another example, the cutting elements 20, 30 may be configured to rotate about the respective longitudinal axes 21, 31 relative to a drill bit to which the cutting elements 20, 30 are secured.

Figure 16:
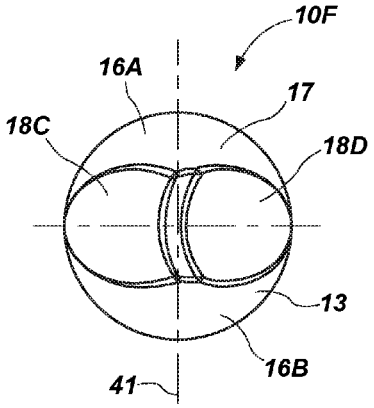
FIG. 16 is a top plan view of another cutting element according to an embodiment of the present disclosure, showing a cutting tip thereof with a curved longitudinal end.

In some embodiments, the longitudinal end 17, 27 of the cutting tip 13, 23 of the present disclosure may be curved relative to a plane in which the longitudinal end 17, 27 extends. For example, as shown in FIG. 16, the longitudinal end 17 of the cutting tip 13 of a cutting element 10F may be generally curved relative to a plane 41 passing longitudinally through a center of the cutting element 10F. The surfaces 18C and 18D may be at least somewhat curved, as well, to form the curvature of the longitudinal end 17. For example, the surface 18C may be at least partially convex proximate the longitudinal end 17, while the surface 18D may be at least partially concave proximate the longitudinal end 17. In some embodiments, only one of the surfaces 18C and 18D is curved, while the other of the surfaces 18C and 18D is at least substantially flat (i.e., planar). Such curved longitudinal ends 17, 27 may be particularly useful when the cutting element 10, 20 is mounted on a cutting face of a drill bit proximate a longitudinal axis of the drill bit, where the radius of a cutting groove is relatively small.

Figure 17:
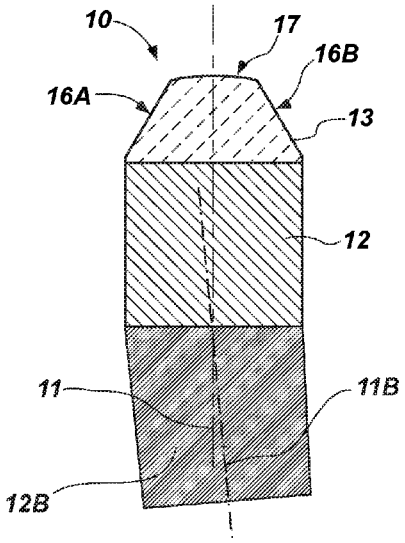
FIG. 17 is a cross-sectional view of a cutting element of the present disclosure mounted to another substrate base in addition to a substrate base of the cutting element.

Referring to FIG. 17, in some embodiments, the cutting element 10 may be coupled to an additional substrate base 12B. By way of example and not limitation, the additional substrate base 12B may be used as a spacer to position the cutting element 10 at a greater exposure relative to an earth-boring tool to which the cutting element 10 is to be attached (e.g., to position the longitudinal end 17 at a greater distance from a surface of the earth-boring tool proximate the cutting element 10). The another substrate base 12B may be substantially similar to the substrate base 12 of the cutting element 10 in form and/or material composition. Thus, in some embodiments, the another substrate base 12B may be substantially cylindrical and may have a longitudinal axis 11B that extends centrally through the another substrate base 12B substantially parallel to an outer cylindrical surface of the another substrate base 12B. In some embodiments, the longitudinal axis 11B of the another substrate base 12B may be substantially parallel to and co-linear with the longitudinal axis 11 of the cutting element 10. In other embodiments, as shown in FIG. 17, the longitudinal axis 11B of the another substrate base 12B may be oriented at an angle to and not co-linear with the longitudinal axis 11 of the cutting element 10. In such embodiments, the another substrate base 12B may be used to orient the cutting tip 13 of the cutting element 10 at a rake angle (e.g., a back rake angle, a forward rake angle, etc.) relative to a formation to be engaged by the cutting tip 13.

The enhanced shape of the cutting elements 10, 20, 30 described in the present disclosure may be used to improve the behavior and durability of cutting elements when drilling in subterranean earth formations. The shape of the cutting elements 10, 20, 30 may enable the cutting elements 10, 20, 30 to fracture and damage the formation, while also providing increased efficiency in the removal of the fractured formation material from the subterranean surface of the wellbore.

During operation, the shape of the cutting elements 10, 20, 30 of the present disclosure may increase point loading and thus may create increased fracturing in earthen formations. Testing shows increased rock fracturing beyond the cut shape impression in the drilled formation. Without being bound to a particular theory, it is believed that the at least partially conical shape of the cutting elements 10, 20, 30 of the present disclosure concentrates stress in formations through which the cutting elements 10, 20, 30 drill, which propagates fracturing beyond a point of contact to a greater extent than conventional cutting elements, such as circular table PCD cutting elements. The increased rock fracturing may lead to greater drilling efficiency, particularly in hard formations. Furthermore, the cutting elements 10, 20, 30 described in the present disclosure may have increased durability due to the cutting elements 10, 20, 30 having a shape that is elongated in one plane (e.g., a plane in which the longitudinal end 17, 27 extends), as described above and shown in the figures. Such a shape may induce increased pre-fracturing of the formation along the elongated edge during operation. Such an elongated shape may increase stability by tending to guide the cutting element 10, 20, 30 in the drilling track or groove formed by the leading cutting edge of the cutting element. Furthermore, the at least partially conical shape of the cutting element 10, 20, 30 may provide depth-of-cut control due to the increasing cross-sectional area of the cutting element 10, 20, 30 in the direction extending along the longitudinal axis 11, 21, 31, 35 thereof.

In some embodiments, the cutting tip 13, 23, 33 of the present disclosure may be at least predominantly comprised of diamond with an interface geometry between the cutting tip 13, 23, 33 and the substrate base 12, 12A, 22 selected to manage residual stresses at the interface. Embodiments of the cutting element 10, 20, 30 of the present disclosure including PCD in the cutting tip 13, 23, 33 may present a continuous cutting face in operation, but with increased diamond volume. The shape of the cutting element 10, 20, 30 may provide increased point loading with the abrasion resistant material (e.g., PCD) thereof supporting the leading edge, which may improve pre-fracturing in brittle and/or hard formations. The ability to pre-fracture the formation may be particularly useful in so-called "managed pressure drilling" (MPD), "underbalanced drilling" (UBD), and/or air drilling applications. The pre-fracturing of the formation may significantly reduce cutting forces required to cut into the formation by any trailing cutting structure, such that the trailing cutting structure(s) may be relatively larger in shape for maximum formation removal.

In addition, the generally flat surfaces 18A, 18B, 28A, and 28B of the present disclosure may act as features that stabilize the cutting elements 10, 20, 30 within a groove cut in the formation. The generally flat surfaces 18A, 18B, 28A, and 28B may be significantly larger in area than the leading cutting edge. Thus, with a small forward cutting face and large blunt side faces, the cutting element 10, 20, 30 may act as a self-stabilizing cutting structure. Drilling efficiency may be improved by the cutting element 10, 20, 30 of the present disclosure at least in part because formation material that is drilled away may follow a less tortuous path than with conventional cutting elements. The generally conical shape of the cutting elements 10, 20, 30 of the present disclosure may cause the exposed surfaces of the cutting elements 10, 20, 30 to experience compression during axial plunging thereof into a formation, which may improve the durability of the cutting elements by eliminating or reducing tensile failure modes. The increased pre-fracturing and drilling efficiency may improve a rate of penetration of a drill bit including the cutting elements 10, 20, 30 of the present disclosure. Any of the cutting elements 10, 20, 30 described in the present disclosure may be used as a primary cutter or as a backup cutter.

Additional non-limiting example embodiments of the present disclosure are set forth below.

Embodiment 1

A cutting element for an earth-boring tool, comprising: a substrate base comprising a substantially cylindrical outer side surface and a longitudinal axis substantially parallel to the substantially cylindrical outer side surface; and a cutting tip comprising: an elongated surface defining a longitudinal end of the cutting tip; a first generally conical surface extending from proximate the substrate base to the elongated surface; a second generally conical surface extending from proximate the substrate base to the elongated surface, the second generally conical surface opposite the first generally conical surface; a first generally flat surface extending between the first generally conical surface, the second generally conical surface, and the elongated surface; a second generally flat surface extending between the first generally conical surface, the second generally conical surface, and the elongated surface, the second generally flat surface opposite the first generally flat surface; and a central axis extending through the cutting tip from an interface between the substrate base and the cutting tip to a central location on the elongated surface; wherein the longitudinal axis of the substrate base is not co-linear with the central axis of the cutting tip.

Embodiment 2

The cutting element of Embodiment 1, wherein the substrate base comprises a first material and the cutting element tip comprises a second material different than the first material.

Embodiment 3

The cutting element of Embodiment 2, wherein the first material comprises a cemented carbide material and the second material comprises an abrasion resistant material selected from the group consisting of a polycrystalline diamond material, a carbide material, a metal-matrix carbide composite material, and a cubic boron nitride material.

Embodiment 4

The cutting element of any one of Embodiments 2 and 3, wherein the second material comprises a polycrystalline diamond material and the cutting tip further comprises a third material formed over the polycrystalline diamond material.

Embodiment 5

The cutting element of any one of Embodiments 2 through 4, wherein substantially all of the cutting element from an interface between a longitudinal end of the substrate base and the longitudinal end of the cutting tip comprises the second material, the second material being a substantially uniform material.

Embodiment 6

The cutting element of any one of Embodiments 2 through 4, wherein the second material comprises a layer over the substrate base, the layer having a substantially uniform thickness.

Embodiment 7

The cutting element of Embodiment 6, wherein the substantially uniform thickness of the second material is at least about 0.15 inch (3.81 mm).

Embodiment 8

The cutting element of any one of Embodiments 1 through 7, wherein the substrate base comprises at least one chamfer around a longitudinal end thereof opposite the cutting tip.

Embodiment 9

The cutting element of Embodiment 8, wherein the at least one chamfer comprises a first chamfer extending around the substrate base between a lateral side surface of the substrate base and a second chamfer, the second chamfer extending around the substrate base between the first chamfer and the longitudinal end of the substrate base opposite the cutting tip.

Embodiment 10

A cutting element for an earth-boring tool, the cutting element comprising: a substantially cylindrical substrate base; and a cutting tip secured to the substrate base, the cutting tip comprising: a first generally conical surface extending from proximate the substrate base toward a longitudinal end of the cutting tip; an opposing second generally conical surface extending from proximate the substrate base toward the longitudinal end of the cutting tip; a first flank surface extending between the first generally conical surface and the second generally conical surface and extending from proximate the substrate base toward the longitudinal end of the cutting tip; and an opposing second flank surface extending between the first generally conical surface and the second generally conical surface and extending from proximate the substrate base toward the longitudinal end of the cutting tip; wherein a surface defining the longitudinal end of the cutting tip is relatively more narrow in a central region thereof than in a radially outer region thereof.

Embodiment 11

The cutting element of Embodiment 10, wherein the cutting tip is angled relative to the substrate base.

Embodiment 12

The cutting element of any one of Embodiments 10 and 11, wherein each of the first flank surface and the second flank surface is substantially flat.

Embodiment 13

The cutting element of any one of Embodiments 10 and 11, wherein the surface defining the longitudinal end of the cutting tip is curved relative to a plane passing longitudinally through a center of the cutting element.

Embodiment 14

The cutting element of any one of Embodiments 10 through 13, further comprising one or more valleys extending into at least one of the first flank surface and the second flank surface.

Embodiment 15

The cutting element of any one of Embodiments 10 through 14, further comprising one or more ridges extending from at least one of the first flank surface and the second flank surface.

Embodiment 16

The cutting element of any one of Embodiments 10 through 14, wherein the cutting tip is configured to rotate relative to the substrate base.

Embodiment 17

An earth-boring tool, comprising: a body; and a plurality of cutting elements attached to the body, each cutting element of the plurality of cutting elements comprising: a substantially cylindrical substrate base; and a cutting tip comprising: a first generally conical surface extending from proximate the substrate base to a longitudinal end of the cutting tip; a second generally conical surface extending from proximate the substrate base to the longitudinal end of the cutting tip, the second generally conical surface opposite the first generally conical surface relative to a longitudinal axis of the cutting tip; a first flank surface extending from proximate the substrate base to the longitudinal end of the cutting tip and extending between the first generally conical surface and the second generally conical surface; and a second flank surface extending from proximate the substrate base to the longitudinal end of the cutting tip and extending between the first generally conical surface and the second generally conical surface, the second flank surface opposite the first flank surface relative to a longitudinal axis of the cutting tip; wherein at least one cutting element of the plurality of cutting elements is oriented relative to the body such that the cutting tip of the at least one cutting element is back raked and configured to initially engage a formation to be bored by the earth-boring tool with one of the first generally conical surface and the second generally conical surface of the at least one cutting element.

Embodiment 18

The earth-boring tool of Embodiment 17, wherein the cutting tip of the at least one cutting element comprises a longitudinal axis extending centrally through the cutting tip from proximate the substrate base to the longitudinal end of the cutting tip that is not co-linear with a longitudinal axis extending centrally through the substrate base.

Embodiment 19

The earth-boring tool of any one of Embodiments 17 and 18, wherein each cutting element of the plurality of cutting elements is oriented relative to the body such that the cutting tip of each cutting element is back raked and the formation to be bored by the earth-boring tool is to be initially engaged by each cutting element with one of the first generally conical surface and the second generally conical surface of each cutting element.

Embodiment 20

The earth-boring tool of any one of Embodiments 17 through 19, wherein the cutting tip of each cutting element of the plurality of cutting elements is configured to rotate relative to the substrate base thereof.

Embodiment 21

The earth-boring tool of any one of Embodiments 17 through 20, wherein the earth-boring tool is a fixed-cutter rotary drill bit.

Embodiment 22

A method of drilling a formation using an earth-boring tool, the method comprising: positioning an earth-boring tool proximate the formation, the earth-boring tool comprising: at least one cutting element, comprising: a substrate base comprising a substantially cylindrical outer side surface; and a cutting tip attached to the substrate base, the cutting tip comprising: an elongated surface defining a longitudinal end of the cutting tip; a first generally conical surface extending from proximate the substrate base to the elongated surface; a second generally conical surface extending from proximate the substrate base to the elongated surface, the second generally conical surface opposite the first generally conical surface; a first generally flat surface extending between the first generally conical surface, the second generally conical surface, and the elongated surface; and a second generally flat surface extending between the first generally conical surface, the second generally conical surface, and the elongated surface, the second generally flat surface opposite the first generally flat surface; and engaging the formation with the at least one cutting element, wherein one of the first generally conical surface and the second generally conical surface of the cutting tip of the at least one cutting element is positioned to initially engage the formation relative to other surfaces of the at least one cutting element.

Embodiment 23

The method of Embodiment 22, further comprising orienting the at least one cutting element such that the cutting tip of the at least one cutting element is back raked relative to the formation.

Embodiment 24

The method of Embodiment 23, wherein orienting the at least one cutting element comprises providing the at least one cutting element with the cutting tip thereof angled relative to the substrate base thereof.

Embodiment 25

A method of forming a cutting element, comprising: forming the cutting element of any one of Embodiments 1 through 16.

Embodiment 26

A method of forming an earth-boring tool comprising: forming the earth-boring tool of any one of Embodiments 17 through 21.

Embodiment 27

A method of drilling a formation using an earth-boring tool, the method comprising: drilling the formation using an earth-boring tool comprising at least one cutting element of any one of Embodiments 1 through 16.

Embodiment 28

A method of drilling a formation using an earth-boring tool, the method comprising: drilling the formation using the earth-boring tool of any one of Embodiments 17 through 21.

Embodiment 29

The earth-boring tool of any one of Embodiments 17 through 21, further comprising at least one alignment feature in or on the body with which the first flank surface and the second flank surface of the at least one cutting element of the plurality of cutting elements are aligned.

Embodiment 30

The cutting element of any one of Embodiments 1 through 16, wherein the substrate base is substantially hollow.

Embodiment 31

The cutting element of any one of Embodiments 1 through 16 and 30, further comprising another substrate base to which the substrate base is coupled.

Embodiment 32

The cutting element of Embodiment 31, wherein the another substrate base is oriented at an angle to the substrate base.

While the present disclosure has been described herein with respect to certain embodiments, those of ordinary skill in the art will recognize and appreciate that it is not so limited. Rather, features from one embodiment may be combined with features of another embodiment while still being encompassed within the scope of the present disclosure as contemplated by the inventor. Furthermore, many additions, deletions and modifications to the embodiments described herein may be made without departing from the scope of the invention as hereinafter claimed, including legal equivalents.

What is claimed is:

1. A drill bit, comprising:
a bit body; and
cutting elements secured to the bit body, at least some of the cutting elements comprising:
a substrate base; and
a cutting tip comprising:
an elongated surface defining an end of the cutting tip;
at least one partially conical surface extending from proximate the substrate base to an end of the elongated surface; and
opposing substantially flat surfaces extending from proximate the substrate base to opposing sides of the elongated surface;
wherein at least some of the cutting elements are mounted to the bit body in a backraked orientation such that the at least one partially conical surface of the cutting tip is positioned and configured, during cutting element movement through a formation, to provide initial engagement of the cutting elements with the engaged formation with a length of the elongated surface of the cutting tip trailing the at least one partially conical surfaced.

2. The drill bit of claim 1, wherein the at least one partially conical surface of the cutting tip comprises a first partially conical surface on a first side of the cutting tip and a second partially conical surface on a second opposing side of the cutting tip.

3. The drill bit of claim 2, wherein:
the first partially conical surface and the second partially conical surface of the cutting tip are substantially symmetrical with respect to each other about a longitudinal axis of the cutting tip; and
the first partially conical surface and the second partially conical surface of the cutting tip are coextensive.

4. The drill bit of claim 1, wherein the opposing substantially flat surfaces of the cutting tip comprise a first substantially flat surface on a first side of the cutting tip and a second substantially flat surface on a second opposing side of the cutting tip.

5. The drill bit of claim 1, wherein the elongated surface of the cutting tip is relatively more narrow in a central region than in a radially outer region.

6. The drill bit of claim 1, wherein the elongated surface of the cutting tip is substantially arcuate and symmetric about a plane passing through a longitudinal axis of the substrate base.

7. The drill bit of claim 1, wherein the substrate base comprises a first material and the cutting tip comprises a second material different than the first material.

8. The drill bit of claim 7, wherein the first material comprises a cemented carbide material and the second material comprises a polycrystalline diamond material.

9. The drill bit of claim 1, wherein the drill bit comprises a fixed-cutter earth-boring rotary drill bit.

10. The drill bit of claim 9, wherein:
the bit body of the fixed-cutter earth-boring rotary drill bit comprises blades, at least some of the blades comprising the backraked cutting elements; and
additional cutting elements are positioned at least one of adjacent to or rotationally behind the backraked cutting elements.

11. An earth-boring tool, comprising:
a bit body; and
cutting elements secured to the bit body, at least some of the cutting elements comprising:
a substrate base; and
a cutting tip secured to the substrate base, the cutting tip comprising:
an elongated surface defining an end of the cutting tip, the elongated surface relatively more narrow in a central region than in a radially outer region;
a first partially conical surface extending from proximate the substrate base toward an end of the cutting tip;
an opposing second partially conical surface extending from proximate the substrate base toward an opposing end of the cutting tip;
a first flank surface extending between the first partially conical surface and the opposing second partially conical surface and extending from proximate the substrate base to the elongated surface; and
an opposing second flank surface extending between the first partially conical surface and the opposing second partially conical surface and extending from proximate the substrate base to the elongated surface; and
wherein at least some of the cutting elements are backraked such that at least one of the first partially conical surface or the opposing second partially conical surface of the cutting tip is configured to provide initial engagement of the cutting elements with a formation with a length of the elongated surface of the cutting tip trailing the first partially conical surface or the opposing second partially conical surface in a direction of cutting element movement through the engaged formation upon operation of the earth-boring tool.

12. The earth-boring tool of claim 11, wherein the substrate base comprises at least one chamfer around a longitudinal end of the substrate base opposite the cutting tip.

13. The earth-boring tool of claim 12, wherein the at least one chamfer comprises:

a first chamfer extending around the substrate base adjacent a lateral side surface of the substrate base; and a second chamfer extending around the substrate base between the first chamfer and the longitudinal end of the substrate base opposite the cutting tip.

14. The earth-boring tool of claim 11, wherein each of the first flank surface and the opposing second flank surface of the cutting tip is at least one of substantially planar or substantially concave.

15. The earth-boring tool of claim 11, wherein the elongated surface defining the end of the cutting tip has a convex arcuate shape.

16. The earth-boring tool of claim 11, wherein at least some of the cutting elements comprise an alignment feature to orient the cutting tip relative to the bit body and the formation.

17. A method of drilling a formation, comprising: rotating a drill bit in contact with a formation to engage the formation with at least some backraked cutting elements, each of the at least some backraked cutting elements having an elongated surface defining an end of a cutting tip thereof, opposing substantially flat surfaces extending from proximate a substrate base to an end of the elongated surface, and an at least partially conical surface facing a direction of bit rotation to provide initial engagement of the cutting elements with the formation and the length of an elongated surface trailing the at least partially conical surface in a direction of cutting element movement responsive to drill bit rotation.

18. The method of claim 17, wherein engaging the formation with the cutting elements comprises inducing prefracturing of the formation along the elongated surface of the cutting tip during operation.

19. The method of claim 17, further comprising engaging the formation with a relatively wider, leading end portion of the elongated surface of the cutting tip having a following, relatively narrower central portion.

* * * * *